United States Patent [19]

Mattos

[11] 4,030,764

[45] June 21, 1977

[54] BRIDGE BIDDING INDICATOR

[76] Inventor: Albert V. Mattos, 397 Southerland Drive, Toronto, Ontario, Canada, M4G 1K2

[22] Filed: June 2, 1976

[21] Appl. No.: 692,095

[52] U.S. Cl. ..... 273/148 A; 273/1 E; 273/148 R; 340/323 R

[51] Int. Cl.[2] ..... A63B 71/06

[58] Field of Search ..... 35/8 B; 273/1 E, 134 A, 273/136 A, 148 R, 148 A, 149 P; 235/92 GA; 340/323 R, 336

[56] References Cited

UNITED STATES PATENTS

| | | | |
|---|---|---|---|
| 2,799,505 | 7/1957 | Lyons | 273/136 A |
| 3,357,704 | 12/1967 | Myers | 273/148 A |
| 3,420,526 | 1/1969 | Berger | 273/148 R |
| 3,654,392 | 4/1972 | Beinhocker | 273/136 A X |
| 3,888,491 | 6/1975 | Bernard et al. | 273/136 A |
| 3,962,800 | 6/1976 | Feldheim | 273/138 A |

*Primary Examiner*—Anton O. Oechsle
*Assistant Examiner*—Vance Y. Hum

[57] ABSTRACT

A bridge bidding indicator includes a frame, a display unit disposed on the frame which includes a multiplicity of electrically actuable indicia representative of a suit or no-trump, the number of tricks, and pass, double and re-double. The plurality of the indicia are disposed in a plurality of rows and columns intersecting with the rows. Each of the rows is indicative of a round of a multiplicity of biddable rounds, and each of the columns is indicative of a bid which can be submitted successively by one and the same player. The indicator includes a signaling unit disposed on the frame, which includes a plurality of manipulable devices indicating the plurality of indicia for selective actuation thereof on the display unit by a player.

2 Claims, 5 Drawing Figures

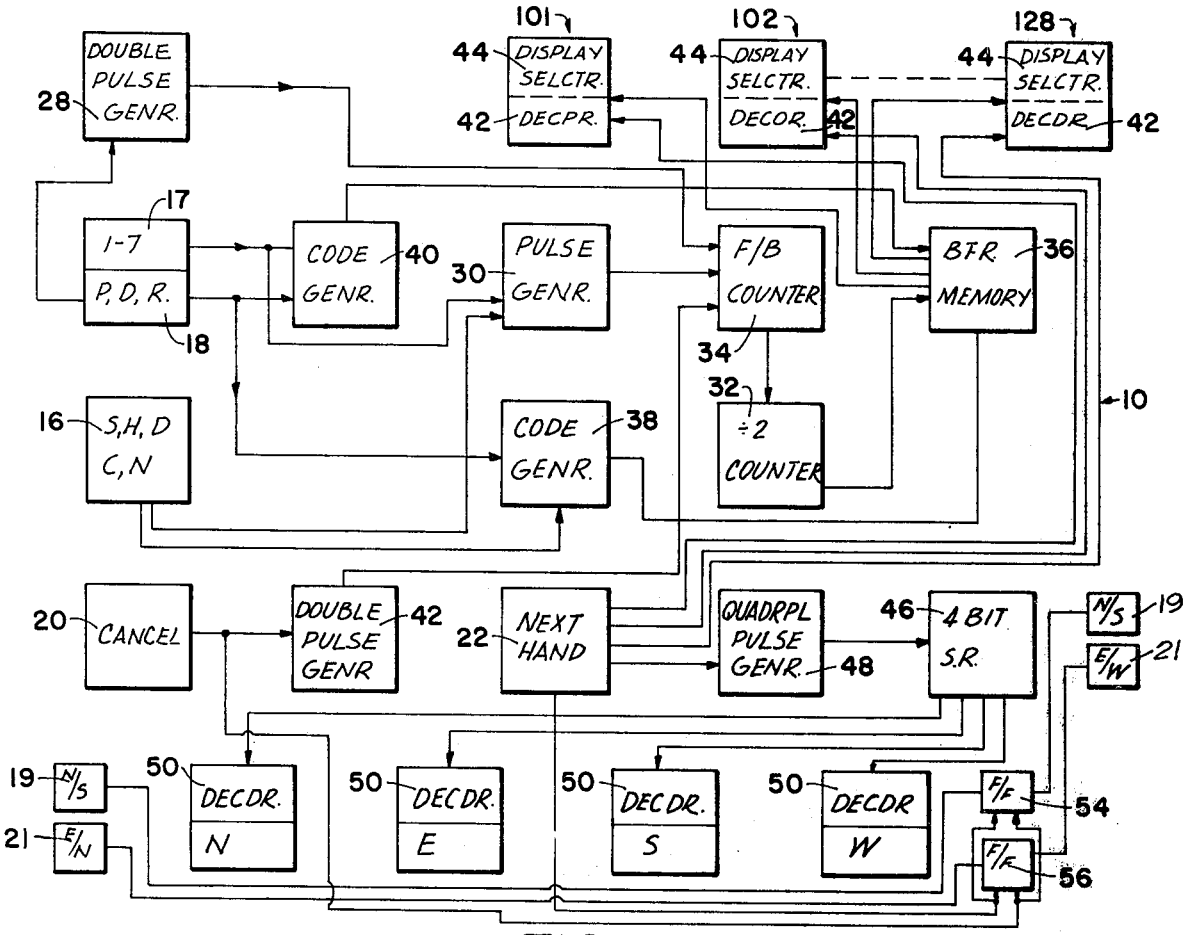
FIG.4
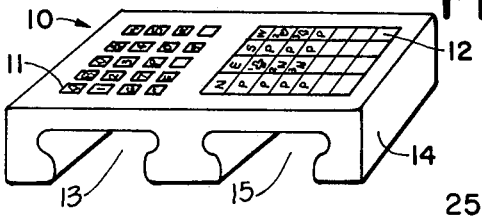
FIG. 1
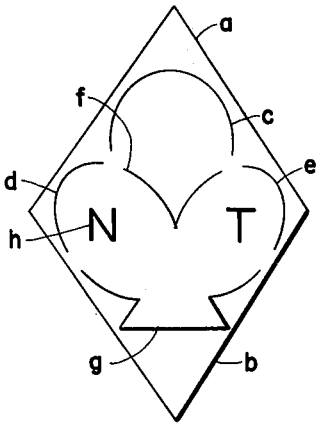
FIG. 3
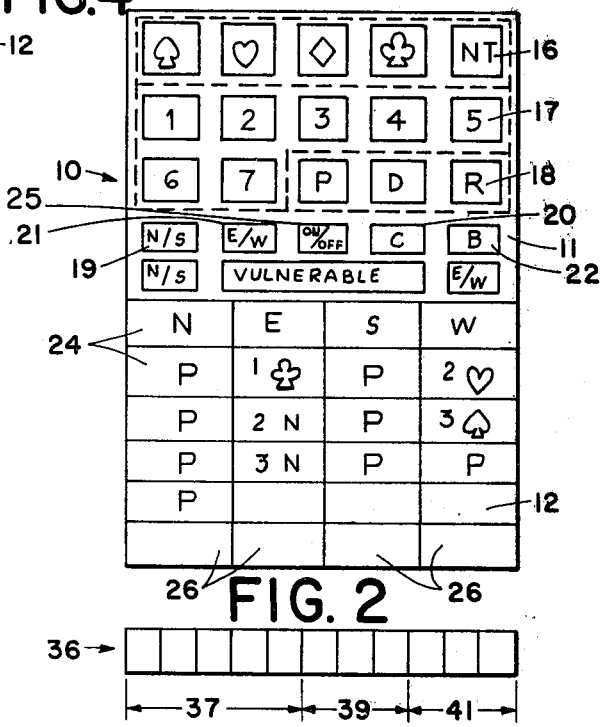
FIG. 2
FIG. 5

BRIDGE BIDDING INDICATOR

BACKGROUND OF THE INVENTION

1. FIELD OF THE INVENTION

The field of the present invention relates to a bridge bidding indicator.

2. DESCRIPTION OF THE PRIOR ART

Known bridge bidding devices use at least one display board and a plurality of consoles, usually four consoles including manipulable means for selectively actuating indicia on the display board. The use of a plurality of consoles is not economical, and means have therefore been sought to reduce the number of consoles, without distracting from the usefulness of the bridge bidding device.

SUMMARY OF THE INVENTION

It is therefore one of the objects of the present invention to devise a bridge bidding indicator, which provides an indication to players of successive bids, and which is economical by using only one signaling unit, and one display unit, while expandable to accommodate additional signaling and display units, if necessary.

The aforesaid object is met by providing a bridge bidding indicator which includes a frame, a display unit disposed on the frame which includes a multiplicity of electrically actuable indicia representative of a suit or no trump, the number of tricks, and pass, double and re-double. The plurality of indicia are disposed in a plurality of rows and columns intersecting with the rows. Each of the rows is indicative of a round of a multiplicity of biddable rounds, and each of the columns is indicative of a bid which can be submitted successively by one and the same player. The indicator includes a signaling unit disposed on the frame which includes a plurality of manipulable means indicating the plurality of indicia for selective actuation thereof on the display unit by a player.

Circuit means are disposed on the frame for causing the display of the indicia on the display unit in a plurality of successive columns and rows, respectively, in dependence of successive actuation of the manipulable means by respective players; the circuit means also include code generator means for digitally encoding the indicia, counting means for counting the number of the indicia encoded by the code generator means, addressing means for routing the encoded indicia to a selected location at an intersection of one of the rows and columns in dependence on the number of indicia counted by the counting means, and decoding means including display selector means for decoding and displaying the decoded indicia routed to the selected location by the addressing means.

It is preferable if the frame of the indicator is formed with a plurality of recesses for holding respective packs of cards, if the display unit includes a plurality of light emitting diodes for displaying the indicia, and if the indicia representative of a suit or no trump include a plurality of separately actuable elements.

It is further advantageous if the first row of the display unit includes a plurality of electrically actuable designations representative of respective players; the designations are actuable and successively shiftable by the manipulable means in, and along the first row, respectively. The manipulable means preferably also include erase means for cancelling the display shown by the last actuation of one of the manipulable means.

The counting means then include a forward/backward counter which can be actuated for a forward count of the indicia and for backward counting by actuation of the erase means. A subsequent actuation of the manipulable means to supersede the erased display then causes the count of the number of indicia to include only displayed indicia.

The bidding indicator preferably also includes manipulable means including clearing means connected to the electrically actuable indicia for clearing and resetting all of the displayed indicia thereon. The manipulable means include a first keyboard which has a first plurality of keys indicating one of the suits or a no trump, respectively, a second keyboard which has a second plurality of keys indicating one of the pass, double and redouble bids, respectively, and a third keyboard which has a third plurality of keys indicating one of the rounds, respectively.

The circuit means includes a single pulse generator connected to the first and third keyboards for generating a single pulse, a first double pulse generator connected to the second keyboard for generating a double pulse, and a second double pulse generator connected to the erase means for generating a double pulse upon depression of a respective key. The circuit means also contains a divide-by-two counter connected to the output of the forward/backward counter. The single and first double pulse generators are connected to the forward/backward counter for the latter to count in a forward direction, and the second double pulse generator is connected to the forward/backward counter to count in a reverse direction.

The decoding means preferably includes a plurality of numbered and addressable first decoder units, and the code generator means includes a first code generator connected to the keys of the first and second keyboards, and a second code generator connected to the keys of the second and third keyboards for generating the digitally encoded indicia. Buffer memory means are connected to the first and second code generators for storing the outputs thereof, respectively, to the forward/backward counter via the divide-by-two counter for storing one half the counts thereof, and to the first decoder units for feeding an address thereto. The clearing means includes a next deal key connected to the first decoder units, a quadruple pulse generator connected to the next deal key, a recirculating shift register connected to the quadruple pulse generator and a plurality of second decoder units connected to the shift register.

The shift register has a plurality of outputs connected to the second decoder units, respectively and the second decoder units are connected to the designations, respectively.

The forward/backward counter thus counts the number of pulses fed thereinto by the pulse generators, and one half of the resultant count is fed to the buffer memory means and routed to the first decoder units. The number or address of the selected first decoder unit corresponds to one half the number of the count representative of the decoder address stored in the buffer memory means and decoded by the selected decoder unit. The selected decoder unit also decodes the encoded indicia fed thereinto upon activation thereof and displays the decoded indicia on the display selector means associated therewith. The player designations can be shifted and displayed upon actuation of the clearing means.

BRIEF DESCRIPTION OF THE DRAWING

The present invention will be better understood with reference to the accompanying drawing in which:

FIG. 1 shows a perspective view of the bridge bidding indicator according to the present invention;

FIG. 2 shows a top view of the bridge bidding indicator of FIG. 1;

FIG. 3 shows a preferred arrangement of light emitting diodes to display the designation of one of the suits; and FIG. 4 shows an electric block circuit diagram of the bridge bidding indicator and FIG. 5 shows a schematic representation of the buffer memory.

DESCRIPTION OF THE PREFERRED EMBODIMENT

Referring now to the drawing, it will be seen that the Bridge Bidding Indicator 10 consists of a signaling unit 11 and a display device 12 normally mounted on a common support or frame 14. The signaling unit 10 has a set of keys 16 denoting the color, or suit of cards to be played, which may be clubs, diamonds, hearts, spades, or no trump. Another set of keys 17 indicates the number of the tricks to be bid, such as 1 Heart, 3 No trump, etc. A third set of keys 18 includes the bid of Pass, and the qualifying bids of Double and Redouble. Also included in the signaling unit is a key 20 denoting that the last entry should be erased, and another key 22 clearing the display device 12 entirely. The frame 14 is formed with two recesses 13 and 15 to hold two packs of playing cards, respectively.

The display device 12 has a plurality of horizontal rows 24, normally not exceeding 8 rows, sometimes limited to only 6 rows, and a plurality of vertical columns 26, normally limited to 4 columns. The first horizontal rows 24 shows the designations or indicia N, E, S and W, and these indicia are shiftable in an endless fashion from left to right. The second row 24 has indicia indicating both the color or suit of bids in a progressive manner, as well as the number of the suit bid. For example, the second row 24, indicating the first round of bidding, may show an entry in the first column of P, by N, i.e. North, the dealer, an entry of 1 Club by E, i.e. East, the second bidder, an entry of P by S, i.e. South, the third bidder, and an entry of 2 Heart by West, the fourth and last bidder. The third row 24 may show successive entries of P, 2N (i.e. No trump), P and 3 S (i.e. spades), the fourth row may show an entry of P, 3N followed by two passes, and a final pass in the fifth row. In the example illustrated that last bid thus occurred during the third round of bidding, by East, and was followed by three passes.

It will be noted that the first row 24 starts with N, the dealer. Since dealing of cards is rotated sequentially, during the next round of play, East will deal, and the second row 24 will carry the player designation E, S, W, N, and during the third round of play the second row will carry the designations or indicia S, W, N and E in that order, etc.

The fourth row contains keys 19 and 21 on the signaling unit 11, and corresponding illuminable indicia N/S and E/W on the display unit 12. The fourth row also contains an On/Off switch 25 for switching the indicator on and off, as well as the Cancel or Erase key 20 and the Next Hand or Begin key 22, the latter clearing the display device 12 entirely. Upon depression of the N/S or E/W keys 19 and 21, the corresponding N/S or E/W indicia are illuminated on the display unit 12 and stay illuminated unit either key 20 or 22 is depressed, clearing the display device entirely. The illumination of the N/S sign indicates that North and South are vulnerable, while illumination of the E/W sign indicates that East and West are vulnerable.

The layout of the bridge indicator shown in FIG. 1 is provided only as an example; the positions of the signaling unit 11 and the display unit 12 may, for example, be reversed, the face of the indicator containing the set of keys 16 and the display indicia may be arranged to slope with respect to the base of the indicator for better visibility, or the keys 16 may be disposed on respective sides of the indicator 10.

FIG. 4 illustrates the mechanization of the device. The set of keys 17 carrying the numeral 1 through 7 indicating one of the respective rounds to be played, and the set of keys 16 designating the color or suit to be played are connected to a pulse generator 30, which generates a single pulse. The set of keys 18 carrying the designations P, D and R are connected to a first double pulse generator 28, generating a double pulse. Both the single pulse generator 30 and the double pulse generator 28 are connected to a forward/backward counter 34, and the forward/backward counter 34 is in turn connected to a buffer memory 36 via a divide-by-two counter 32.

The buffer memory 36 includes 11 bits, of which the first 5 bits are reserved for an address 37 for the purpose of routing it to the proper location in the display device 12, the next three bits 39 are reserved for the color of the suit or no trump, or the designations P, D or R, and the next three bits 41 are reserved for the multiple or number of tricks of the suit - e.g. 2 hearts.

Since there may be up to 28 locations in the display device, excluding the location for N, E, S and W, 5 bits are allotted to the address part 37 of the buffer memory 35.

The forward/backward counter 34 thus counts 2 units forward for every pulse or impulse received from the set 18 of the P, D or R keys, but counts only one unit forward upon receiving a pulse from one of the suit designating keys 16 or from the one of the numeral-designating keys 18. Thus, for example, if "P" is entered, two pluses enter the forward-backward counter 34; if the numeral "1" is entered, followed by the color or suit "clubs", then, two consecutive pulses are generated by the pulse generators 30 and 38 respectively, and two pulses enter the forward/backward counter 34. The forward/backward counter 34 thus acts as an address allocator, one half of the respective number temporarily stored therein being equal to the location or address of the display device, to which the information content following the address has to be routed. It is therefore followed by the divide-by-two counter 32, which halves that count.

Depression of one of the suit-designating keys also results in the generation of a 3 bit code in a code generator 38, the latter being connected to the keys of keyboard 16 and to the buffer memory 36, corresponding to the suit designated; e.g. if 000 stands for clubs, 001 for diamonds 010 for hearts, 011 for spades, and 100 for no trumps, then the corresponding bit sequence will be entered into the first 3 bits of the information register 39 of the buffer memory 36. Equally, upon entry of one of the set of numeral designating keys 17 connected to a code generator 40 a corresponding numeral will be entered by code generator 40 connected to the buffer memory 36 into the second 3 bit information register of the buffer memory 36 shown in FIG. 5. Seven of the available binary bit combinations of the second 3-bit register 41 are alloted to numerals corresponding to 1 to 7, while the remaining eight's bit combination, e.g. "111" is reserved for another purpose, to be explained later.

The possible bits P, D or R result in the generation of a 3 bit code to be entered into the first 3 bit register 39 of the buffer memory 36, via the code generator 38, e.g. P may correspond to 101, D to 110, and R to 111. In addition, the remaining eight's bit combination, of the second 3 bit register 41 i.e., in the example illustrated the combination "111" above, will be allotted to any one of the designations P, D and R to fill up the second 3 bit register 41 of the buffer memory 36. For this reason the keys P, D and R are connected to both the code generator 38 as well as to the code generator 40. Upon the buffer memory 36 being filled up, the resulting 11 bit code word stored therein in its 5 bit address portion 37 is automatically read out to the corresponding address of one of the decoder units 41, to which the buffer memory 36 is connected; for example, if the address "00001" corresponds to the first display location, the information content of the first and second information-containing 3-bit portions 37 and 39 of the buffer memory 36 is read out to the first display location in the display device 12.

Each display location or address 101–128 contained in the display device 12 contains a decoder 42 and a symbol display selector 44. The decoders 42 accept the information fed thereto from the buffer memory 36 and only pass it through to the symbol display selector 44, if the address passed to one of the decoders 42 from the buffer memory 36 is identical with the prestored address in one of the decoders 42. Each display selector 44 contains a plurality of light emitting diodes (L.E.D.'s) and the symbols 1 through 7, P, D and R, as well as the symbols for a club, a diamond, a heart and a spade, which can be made up from seven separate elements "*a*" through "*g*" as illustrated in FIG. 3. Additionally, the "No Trump" sign is composed of elements "*h*" and "*i*". Those symbols which are fed to a display selector 44 from the two 3 bit information sections 39 and 41 will then light up.

The signaling unit also contains the erase or cancel key 20, and the "next Hand" or "begin" key 22. The erase key 20 is used, if an error has been made in a current entry, and will erase the last entry made; the begin key 22 is used when the bidding has been completed, and the display of the bidding rounds is no longer needed, so that the Bridge bidding indicator 10 can be cleared for the entry of the next hand.

The erase or cancel key 20, being connected to a double pulse generator 42, and therefrom to the forward/backward counter 34, operates by commanding the forward/backward counter 34 to count two counts backwards via the second double pulse generator 42. A new input from the keys 16 and/or 17 and 18 will therefore produce the same address as the last entry, and new information inputted to the corresponding display decoder — one of the decoding units 42 located in locations 101 through 128 — will automatically erase the old information.

The begin key, i.e., the key 22, erases the information in the buffer memory, setting it to a non-operative address code, and thus erases all display information.

The begin key 22 additionally, upon depression, clocks a 4 bit "endless" shift register 46, which shifts four bits out at a time, having a total capacity of 16 bits. This is accomplished by the output of the next hand key 22 being fed to a quadruple pulse generator 48, which is in turn connected to a 4 bit shift register 46, and generates four sequential pulses, shifting the shift register 46 by four bits at a time. N, E, S and W corresponds to the bit combinations, for example, of 00, 01, 10 and 11 respectively, and this coded information is fed from the quadruple pulse generator 48 in parallel to four decoders 50, each decoder 50 being able to display either N, E, S and W, and actually displays the symbol corresponding to the code fed thereinto. The symbols N, E, S and W stay lit up whenever the On-Off switch 25 of the Bridge bidding indicator 10 is thrown into the ON position. The begin key 22 is also connected to the decoders 42 for resetting and clearing of the latter.

Mechanization or implementation of entry of the N/S or E/W vulnerability is obtained as follows: depression of the N/S key 19 or the E/W key 21 actuates the "set" input of respective flip-flops 54 and 56, which in turn cause illumination of the respective N/W or E/W signs or indicia on the display unit 12. The "reset" inputs of flip-flops 54 and 56 are connected to the "Cancel last bid" key 20 and the "Begin" or "Next Hand" key 22 to clear the N/S and E/W keys when needed.

Although the invention has been described with respect to a preferred form thereof, it is to be understood that it is not to be so limited since changes can be made therein which are within the full intended scope of this invention as defined by the appended claims.

What is claimed is:

1. A bridge bidding indicator comprising:

a frame formed with a plurality of recesses for holding respective packs of cards;

a display unit disposed on said frame, said display unit including a multiplicity of electrically actuable indicia representative of a suit or no-trump, the number of tricks, and pass, double and re-double, said display unit including a plurality of light-emitting diodes for displaying said indicia, said indicia being representative of a suit or no-trump, each of said indicia including a plurality of separately actuable elements, said indicia being disposed in a plurality of rows and columns intersecting with said rows, each of said rows being indicative of a round of a multiplicity of biddable rounds, and each of said columns being indicative of a bid submittable successively by one and the same player;

a signalling unit disposed on said frame, said signalling unit including a plurality of manipulable means indicating said plurality of inidica for selective actuation thereof on said display unit by a player, the first of said rows of said display unit including a plurality of electrically actuable designations representative of respective players, and wherein said designations are actuable and successively shiftable by said manipulable means in, and along said first row respectively; and circuit means disposed on said frame for causing the display of said indicia on said display unit in a plurality of successive columns and rows, respectively, in dependence of successive actuation of said manipulable means by respective players, said circuit means including code generator means for digitally encoding said indicia, counting means for counting the number of said indicia encoded by said code generator means, and wherein said manipulable means include erase means for cancelling the display shown by the last actuation of one of said manipulable means, wherein said counting means include a forward/backward counter actuable for a forward count of said indicia and for backward counting by actuation of said erase means, and wherein a subsequent actuation of said manipulable means to supersede the erased display causes the count of said number of said indicia to include only displayed indicia, the manipulable means including clearing means connected to said electrically actuable indicia for clearing and resetting all of said display indicia thereon, said manipulable means including a first keyboard having a first plurality of keys indicating one of the suits or a no-trump, respectively, a second keyboard having a second plurality of keys indicating one of the pass, double and re-double bids, respectively, and a third keyboard having a third plurality of keys indicating one of the rounds, respectively, said circuit means including addressing means for routing said encoded indicia to a selected location at an intersection of one of said rows and columns in dependence on the number of indicia counted by said counting means and decoding means, and including display selector means for decoding and displaying the decoded indicia routed to said selected location by said addressing means, and wherein said circuit means includes a single pulse generator connected to said first and third keyboards for generating a single pulse, and a first double pulse generator connected to said second keyboard for generating a first double pulse, a second double pulse generator connected to said erase means for generating a second double pulse upon depression of one of said keys, respectively, a divide-by-two counter connected to the output of said forward-/backward counter, and wherein said single and said first double pulse generators are connected to the output of said forward/backward counter, for the latter to count in a forward direction, and said second double pulse genrator is connected to said forward/backward counter to count in a reverse direction.

2. A bridge bidding indicator according to claim 1, wherein said decoding means include a plurality of numbered and addressable first decoder units, said code generator means includes a first code generator connected to said keys of said first and second keyboards, and a second code generator connected to said keys of said second and third keyboards for generating the digitally encoded indicia and further comprising buffer memory means connected to said first, and second code generators for storing the outputs thereof, respectively, to said forward/backward counter via said divide-by-two counter for storing one half the counts thereof, and to said first decoder units for feeding an address thereto, and wherein said clearing means includes a next deal key connected to said first decoder units, a quadruple pulse generator connected to said next deal key, a recirculating shift register connected to said quadruple pulse generator and a plurality of second decoder units connected to said shift register, said shift register having a plurality of outputs connected to said second decoder units, respectively, said second decoder units being connected to said designations, respectively, whereby said forward/backward counter counts the number of pulses fed thereinto by said pulse generators, and one half of the resultant count is fed to said buffer memory means and routed to the first decoder units, the number of the selected one of said first decoder units corresponding to one half the number of the count representative of the decoder address stored in said buffer memory means and decoded by the selected decoder unit, said selected decoder unit decoding the encoded indicia fed thereinto upon activation thereof and displaying the decoded indicia on the display selector means associated therewith, and said designations are shiftably displayable upon actuation of said clearing means.

* * * * *